US006139671A

United States Patent [19]

Shin-Dih

[11] Patent Number: 6,139,671

[45] Date of Patent: Oct. 31, 2000

[54] METHOD FOR MANUFACTURING PENCILS HAVING A PAPER-MADE CYLINDER

[76] Inventor: Su Shin-Dih, No. 311-1, Shin Pyi, Shin Pyi Li, Tay Bao City, Jiayih Hsien, Taiwan

[21] Appl. No.: 09/157,111

[22] Filed: Sep. 18, 1998

[51] Int. Cl.[7] ..... B65H 81/00; B31C 13/00

[52] U.S. Cl. ..... 156/187; 156/192; 156/191

[58] Field of Search ..... 156/185, 187, 156/191, 192, 195, 580, 186

[56] References Cited

U.S. PATENT DOCUMENTS 2,259,959 10/1941 Miller ..... 493/329

5,417,786 5/1995 Denman et al. ..... 156/187

*Primary Examiner*—Richard Crispino
*Assistant Examiner*—George R. Koch, III
*Attorney, Agent, or Firm*—Rosenberg, Klein & Lee

[57] ABSTRACT

A method for manufacturing pencils having paper-made cylinder includes step (1): preparing a paper sheet, step (2): tensing the paper sheet by pressing rollers, step (3): immersing the paper sheet in a tank having glue received therein, step (4): drying the paper sheet, step (5): placing lead sticks on the paper sheet at an equal interval, step (6): cutting the paper sheet into sections and each of the sections having one lead stick thereon, step (7): scrolling the section of paper sheet to wrap the lead stick, and step (8): pressing the scrolled paper sheet.

5 Claims, 3 Drawing Sheets

METHOD FOR MANUFACTURING PENCILS HAVING A PAPER-MADE CYLINDER

FIELD OF THE INVENTION

The present invention relates to a method for manufacturing pencils which have a paper-made cylinder in which a lead or graphite stick is received.

BACKGROUND OF THE INVENTION

A conventional pencil generally comprises a lead or graphite stick and a wooden cylinder in which the lead stick is securely received. The wooden cylinder is composed by two halves and each of which has a semi-circular groove defined therein so that the two halves are glued together with the lead stick securely received in the passage defined by the two grooves of the two halves. It takes a lot of processes to let the wood board cut from trees become the halves with small diameter and elongated shape. In order to have such wooden cylinders, trees have to be cut tremendously and such cutting violates the sense of environmental protection.

The present invention intends to provide a method for manufacturing pencils having a paper-made cylinder so that the pencils need no wood at all. By the method of the present invention, the inherent shortcomings of the conventional pencils having wooden cylinders are removed.

SUMMARY OF THE INVENTION

In accordance with one aspect of the present invention, there is provided a method for manufacturing pencils having paper-made cylinder, comprising the following steps: step (1): preparing a paper sheet, step (2): tensing the paper sheet by pressing rollers, step (3): immersing the paper sheet in a tank having glue received therein, step (4): drying the paper sheet, step (5): placing lead sticks on the paper sheet at an equal interval, step (6): cutting the paper sheet into sections and each of the sections having one lead stick thereon, step (7): scrolling the paper sheet to wrap the lead stick, and step (8): pressing the scrolled paper sheet.

An object of the present invention is to provide a method for effectively and quickly manufacturing pencils having paper-made cylinders.

Further objects, advantages, and features of the present invention will become apparent from the following detailed description with appropriate reference to the accompanying drawings.

DETAILED DESCRIPTION OF THE PREFERRED EMBODIMENT

Figure 1:
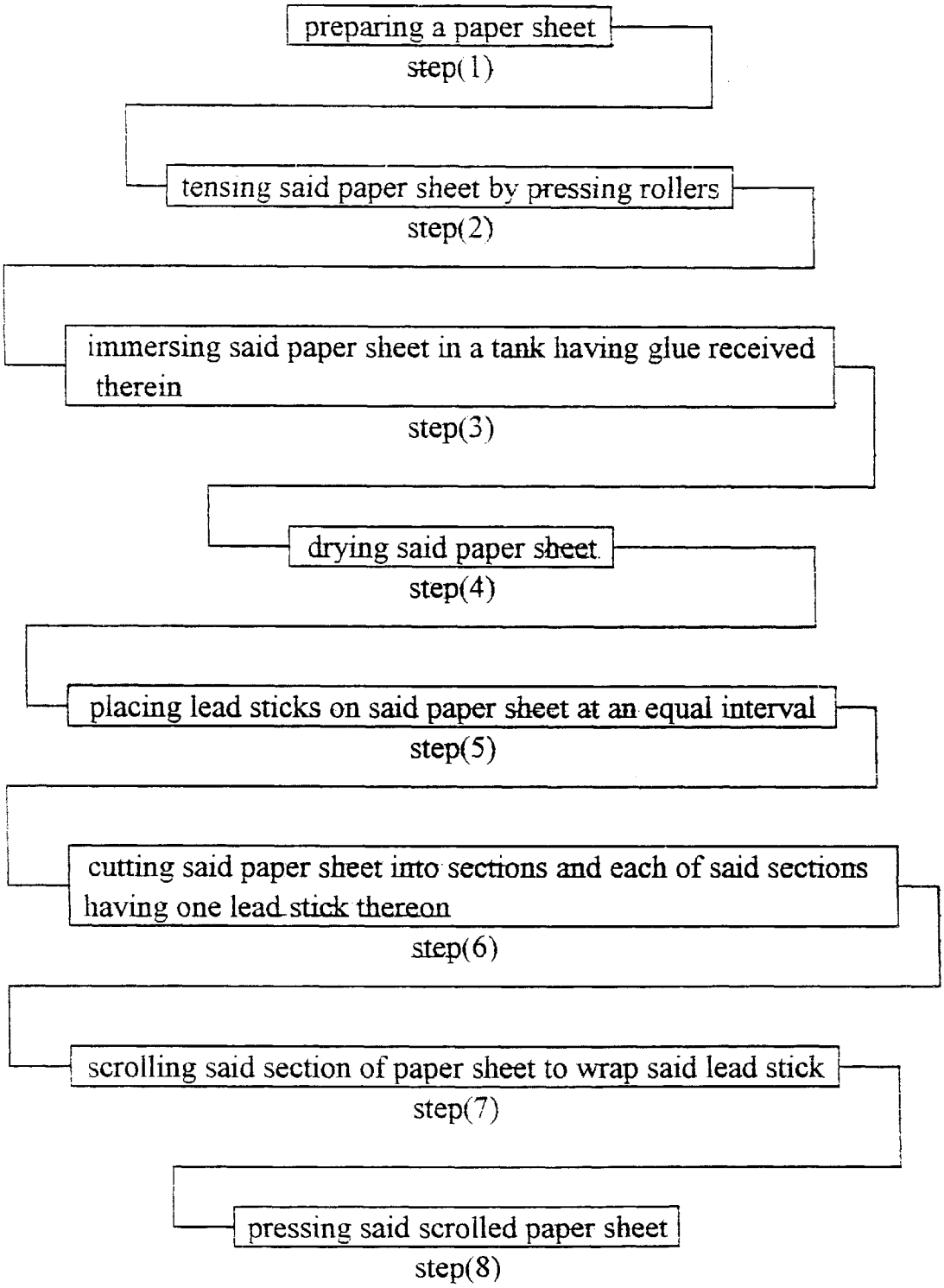
FIG. 1 is a flow chart for illustrating steps of the method in accordance with the present invention.
Figure 3:
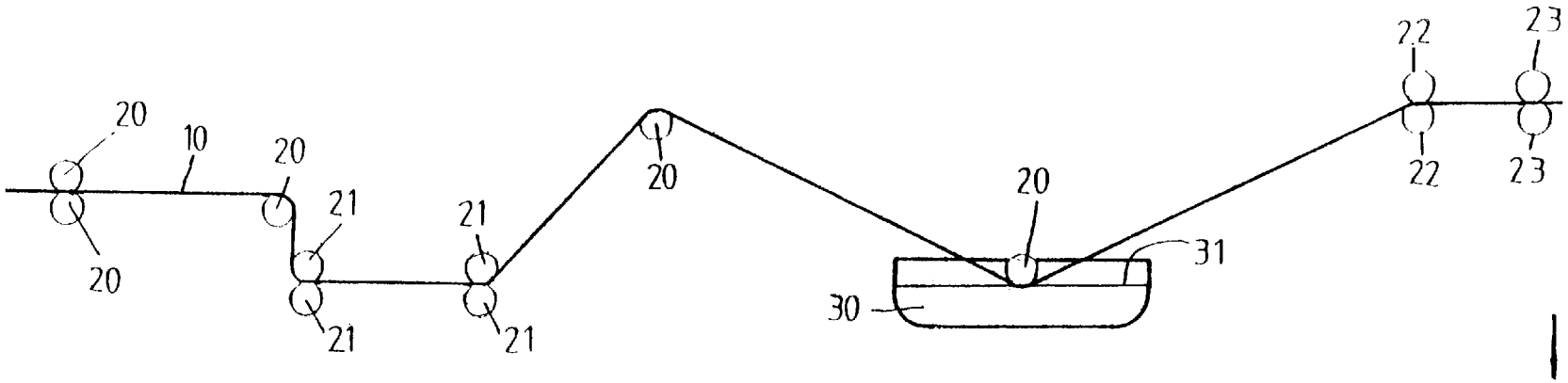
FIG. 3 is an illustrative view to illustrate the steps of tensing the paper sheet and immersing the paper sheet into the glue tank.
Figure 2:
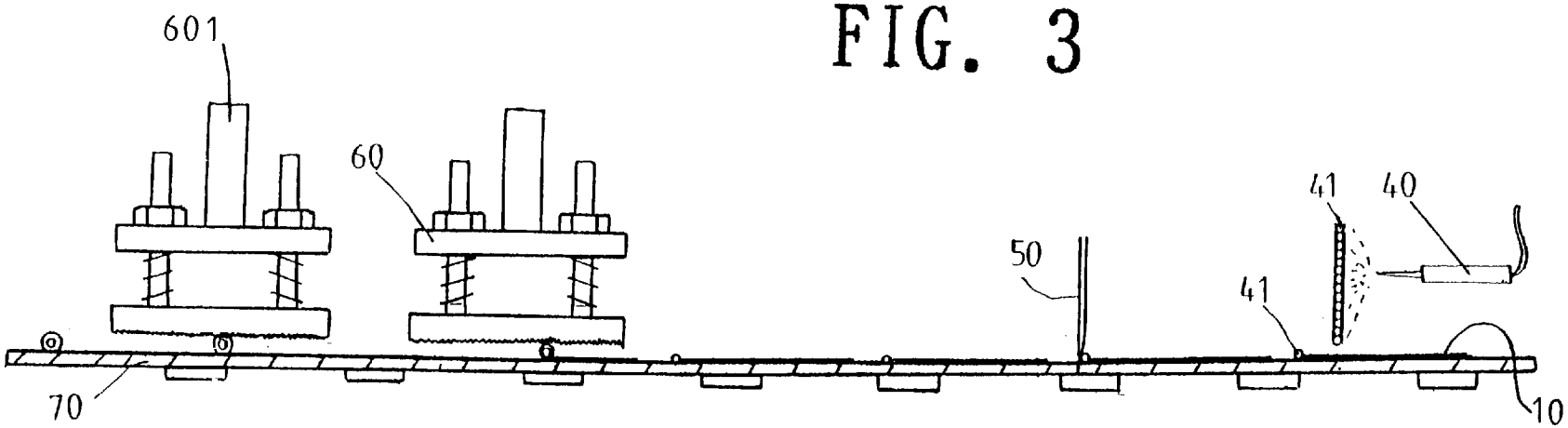
FIG. 2 is an illustrative view to illustrate the steps of placing lead sticks on the paper sheet, cutting the paper sheet, scrolling the section of paper sheet and pressing the scrolled paper.

Referring to FIGS. 1 to 3, the method for manufacturing pencils having paper-made cylinder in accordance with the present invention comprises the following steps:

step (1): preparing a paper sheet 10 which can be a reused or recycled paper sheet;

step (2): transmitting the paper sheet 10 by rollers 20 and tensing the paper sheet 10 by pressing rollers 21;

step (3): immersing the paper sheet 10 in a tank 30 having glue 31 received therein and pressing the paper sheet 10 having glue 31 thereon by two rollers 22 to spread the glue 31 evenly;

step (4): drying the paper sheet 10 to remove 70% of moist in the paper sheet 10 by heating rollers 23;

step (5): placing lead sticks 41 on the paper sheet 10 at an equal interval, wherein the paper sheet 10 is moved on a transmitting device 70 and the lead sticks 41 are adhered with glue by a glue sprayer 40 before being placed onto the paper sheet 10;

step (6): cutting the paper sheet 10 by a knife 50 into sections and each of the sections having one lead stick 41 thereon, and the lead stick 41 being adhered to one of two end edges of the section of the paper sheet 10 corresponding thereto;

step (7): scrolling the section of paper sheet 10 to wrap the lead stick, wherein a first pressing device 70 is lowered to slightly press the lead stick 41 while the section of paper sheet 10 is still forwarded so that the section of the paper sheet 10 wraps around the lead stick 41, and step (8): a second pressing device 601 being used to press the scrolled paper sheet so further combine the paper sheet 10 and the lead stick 41.

Figure 4:
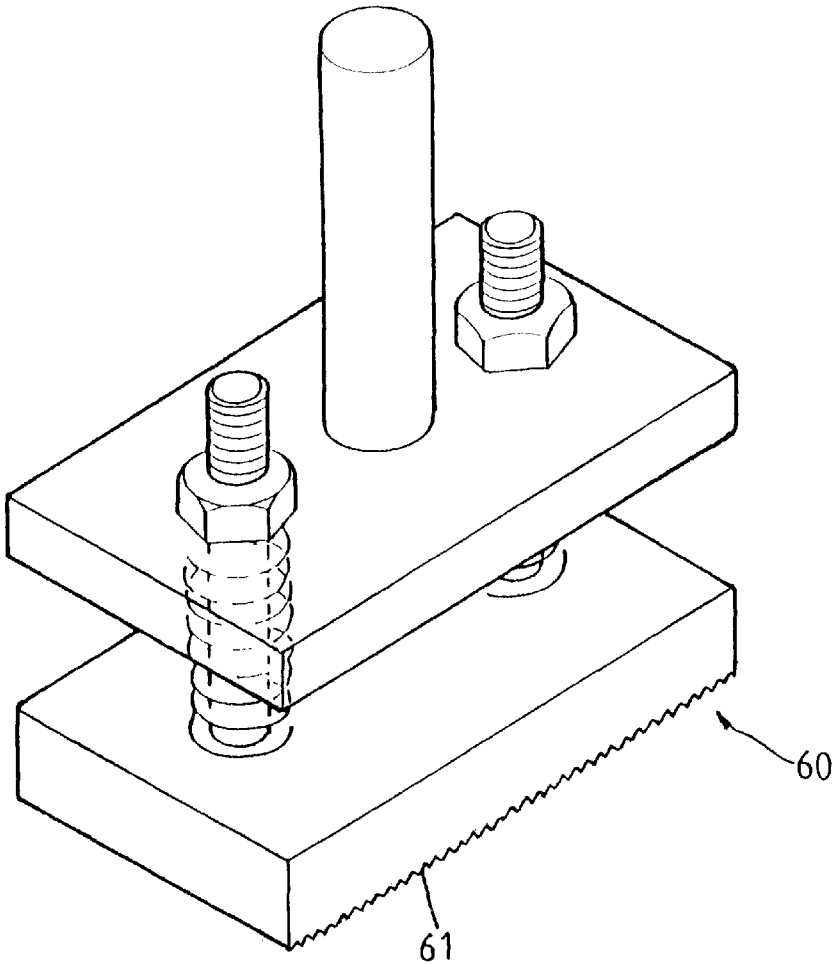
FIG. 4 is a perspective view to show the pressing device used in the method.
Figure 5:
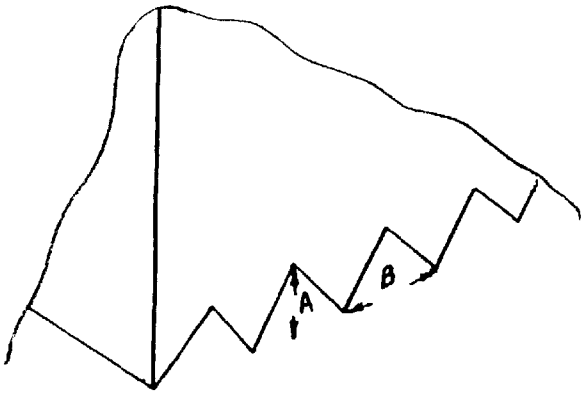
FIG. 5 is an illustrative view to show the toothed underside of the pressing device.

Referring to FIGS. 4 and 5, it is to be noted that the first and the second pressing device 60, 601 each have a toothed underside 61 and the distance "B" between every two adjacent teeth of the pressing device is 1.5–1.0 mm and the depth "A" of each of the teeth of the pressing device is 1.6–2.3 mm.

By this method of the present invention, the pencils can be manufactured quickly. Besides, the paper sheet 10 can be formed by using recycled and reused paper products, which is meet the requirements of the trends of senses of environmental protection.

The invention is not limited to the above embodiment but various modification thereof may be made. It will be understood by those skilled in the art that various changes in form and detail may made without departing from the scope and spirit of the present invention.

What is claimed is:

1. A method for manufacturing pencils having paper-made cylinder, comprising the following steps:

step (1): preparing a paper sheet;

step (2): tensing said paper sheet by pressing rollers;

step (3): immersing said paper sheet in a tank having glue received therein;

step (4): drying said paper sheet;

step (5): placing lead sticks on said paper sheet at an equal interval;

step (6): cutting said paper sheet into sections and each of said sections having one lead stick thereon;

step (7): scrolling said section of paper sheet to wrap said lead stick, and step (8): pressing said scrolled paper sheet with a pressing device having a toothed underside.

2. The method as claimed in claim 1, wherein said lead sticks are adhered with glue before being placed onto said paper sheet.

3. The method as claimed in claim 1, wherein 70% of moisture in said paper sheet in step (4) is removed.

4. The method as claimed in claim 1 further comprising pressing with an additional pressing device in step (7) to press said lead stick and said section of paper sheet being transmitted on a transmitting device so that said section of paper sheet wraps around said lead stick.

5. The method as claimed in claim 1, wherein the distance between every two adjacent teeth of said pressing device is 1.5–1.0 mm and the depth of each of said teeth of said pressing device is 1.6–2.3 mm.

* * * * *